US005767874A

United States Patent [19]

Wen et al.

[11] Patent Number: 5,767,874

[45] Date of Patent: Jun. 16, 1998

[54] PRINTING UNIFORMITY USING NARROW PRINTHEAD SEGMENTS IN DIGITAL PRINTERS

[75] Inventors: Xin Wen; William Yurich Fowlkes, both of Rochester, N.Y.

[73] Assignee: Eastman Kodak Company, Rochester, N.Y.

[21] Appl. No.: 615,366

[22] Filed: Mar. 14, 1996

[51] Int. Cl.[6] ..... B41J 2/145; B41J 2/15; B41J 2/47; B41J 2/435

[52] U.S. Cl. ..... 347/40; 347/234

[58] Field of Search ..... 347/233, 234, 347/237, 238, 200, 240, 12, 13, 40; 400/82

[56] References Cited

U.S. PATENT DOCUMENTS 4,999,646 3/1991 Trask .

FOREIGN PATENT DOCUMENTS 0 539 157 A2 10/1992 European Pat. Off. ..... B41J 2/21

*Primary Examiner*—Benjamin R. Fuller
*Assistant Examiner*—Thinh Nguyen
*Attorney, Agent, or Firm*—Milton S. Sales

[57] ABSTRACT

A recording method for a printer having a printhead formed of an array of narrow segments that are distributed across the printhead so that there is a boundary between adjacent segments includes (i) applying a first two-dimensional modulation function to one of the segments to produce a first band of pixels on a recording medium, the first modulation function gradually decreasing from ONE to ZERO toward the boundary between said one segment and the adjacent segment; and (ii) applying a second two-dimensional modulation function to the adjacent segment to produce a second band of pixels on the recording medium adjacent the end of the first band, the second modulation function gradually decreasing from ONE to ZERO toward the boundary such that the total modulation function applied to the media is the sum of the modulation functions of the first and second bands. Preferably, the modulation functions applied to adjacent segments are of mirror symmetry. Each modulation function decreases from ONE to ZERO over a range of more than one pixel; about twelve pixels being preferred. The printhead is as wide as a full print line across the media, and the segments are staggered across the printhead.

18 Claims, 4 Drawing Sheets

PRINTING UNIFORMITY USING NARROW PRINTHEAD SEGMENTS IN DIGITAL PRINTERS

BACKGROUND OF THE INVENTION

1. Technical Field

This invention relates generally to digital printers, and more specifically to such printers that have narrow printhead segments which produce adjacent bands of pixels.

2. Background Art

Printheads narrower than the page width, such as disclosed in U.S. Pat. No. 5,384,587, which issued to Takagi et al. on Jan. 24, 1995, require multiple parallel swaths the printing each image plane, as shown in FIG. 1, wherein a narrow printhead prints one image plane by multiple parallel swaths. The width of the swaths is determined by the width of the printhead. Whereas the narrower printheads have the advantage of lower cost, they are very slow.

The printing speed of digital printers depends on the width of the printhead. A cross-the-page, full width printhead can print an image plane in a single pass, and is therefore most desirable for high speed printing. But full width printheads have the disadvantages of being more difficult and costly to fabricate because a single defect in the head makes an entire head defective.

One alternative to the full width printhead is to use an array of narrow printhead segments that are laid out across the page, as shown in FIG. 2. The printhead segments are distributed in a staggered fashion so that the printing areas of the neighboring segments overlap with each other, as shown in FIG. 3. This design saves cost and also allows the flexibility of being able to separately replace each individual printhead segment if one becomes defective. However, "banding" defects often occur at the interface between adjacent printhead segments.

Banding is caused by misregistration between the printhead segments of the array. For example, if adjacent printhead segments overlap by one pixel, a dark line occurs in the overlap. Likewise, if there is a one pixel wide gap between adjacent printhead segments of the array, a line will not be printed, leaving a white line in between the two segments. This problem exists in both continuous tone and halftone, and in different types of digital printers (such as those using resistive thermal, ink jet, laser, and silver halide technologies).

The occurrence of banding is depicted in FIGS. 4–6. An image plane is printed by applying a two-dimensional actuation function to the media sheet by the printhead. In thermal printers, this actuation function is the number of heating pulses at each pixel of the image. The printing by two adjacent printhead segments is graphically represented by modulation functions of FIGS. 4(*a*) and 4(*b*), respectively. The total modulation function applied to the media sheet is the sum of the modulation functions of all the segments in the printhead array. FIG. 4(*c*) illustrates the ideal modulation function applied to the media sheet by the modulation functions of FIGS. 4(*a*) and 4(*b*).

In contrast, the printing by two adjacent printhead segments that have a single-pixel overlap is graphically represented by modulation functions of FIGS. 5(*a*) and 5(*b*), respectively. Again, the total modulation function applied to the media sheet is the sum of the modulation functions of all the segments in the printhead array. FIG. 5(*c*) illustrates the modulation function applied to the media sheet by the modulation functions of FIGS. 5(*a*) and 5(*b*). Note that a dark band will result at the overlap, as indicated by the positive spike in the modulation function of FIG. 5(*c*).

Printing by two adjacent printhead segments that have a single-pixel gap is graphically represented by modulation functions of FIGS. 6(*a*) and 6(*b*), respectively. Once again, the total modulation function applied to the media sheet is the sum of the modulation functions of all the segments in the printhead array. FIG. 6(*c*) illustrates the modulation function applied to the media sheet by the modulation functions of FIGS. 6(*a*) and 6(*b*). Note that a light band will result at the gap, as indicated by the negative spike in the modulation function of FIG. 6(*c*).

DISCLOSURE OF THE INVENTION

It is an object of the present invention to provide a printhead array design that minimizes the banding problem for the printhead.

According to the present invention, the discontinuous modulation functions illustrated in FIGS. 4(*a*) and 4(*b*) are replaced by modulation functions that gradually change from ONE to ZERO over a range of pixels. These gradually-changing modulation functions have the following properties:

1. The sum of the $n^{th}$ and $(n+1)^{th}$ modulation function is equal to one.
2. The modulation function may monotonically vary from ZERO to ONE, or vice versa, along the x-direction in a range wider than one pixel.
3. The $n^{th}$ and $(n+1)^{th}$ modulation functions are of mirror symmetry relative to the border between printhead segments.

According to a feature of the present invention, a recording method for a printer having a printhead formed of an array of narrow segments that are distributed across the printhead so that there is a boundary between adjacent segments includes applying a two-dimensional modulation function to each of the segments to produce bands of pixels on a recording medium, the modulation function gradually decreasing from ONE to ZERO toward the boundary between each of said segments and the adjacent segment.

According to another feature of the present invention, a recording method for a printer having a printhead formed of an array of narrow segments that are distributed across the printhead so that there is a boundary between adjacent segments includes (i) applying a first two-dimensional modulation function to one of the segments to produce a first band of pixels on a recording medium, the first modulation function gradually decreasing from ONE to ZERO toward the boundary between said one segment and the adjacent segment; and (ii) applying a second two-dimensional modulation function to the adjacent segment to produce a second band of pixels on the recording medium adjacent the end of the first band, the second modulation function gradually decreasing from ONE to ZERO toward the boundary such that the total modulation function applied to the media is the sum of the modulation functions of the first and second bands.

In a preferred embodiment of the present invention, the modulation functions applied to adjacent segments are of mirror symmetry. Each modulation function decreases from ONE to ZERO over a range of more than one pixel; about twelve pixels being preferred. The printhead is as wide as a full print line across the media, and the segments are staggered across the printhead.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 4(*c*) illustrates the modulation function applied to a media sheet by the modulation functions of FIGS. 4(*a*) and 4(*b*);

FIG. 5(*c*) illustrates the modulation function applied to a media sheet by the modulation functions of FIGS. 5(*a*) and 5(*b*);

FIG. 6(*c*) illustrates the modulation function applied to a media sheet by the modulation functions of FIGS. 6(*a*) and 6(*b*);

FIG. 7(*c*) illustrates the modulation function applied to a media sheet by the modulation functions of FIGS. 7(*a*) and 7(*b*);

FIG. 8(*c*) illustrates the modulation function applied to a media sheet by the modulation functions of FIGS. 8(*a*) and 8(*b*);

FIG. 9(*c*) illustrates the modulation function applied to a media sheet by the modulation functions of FIGS. 9(*a*) and 9(*b*).

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
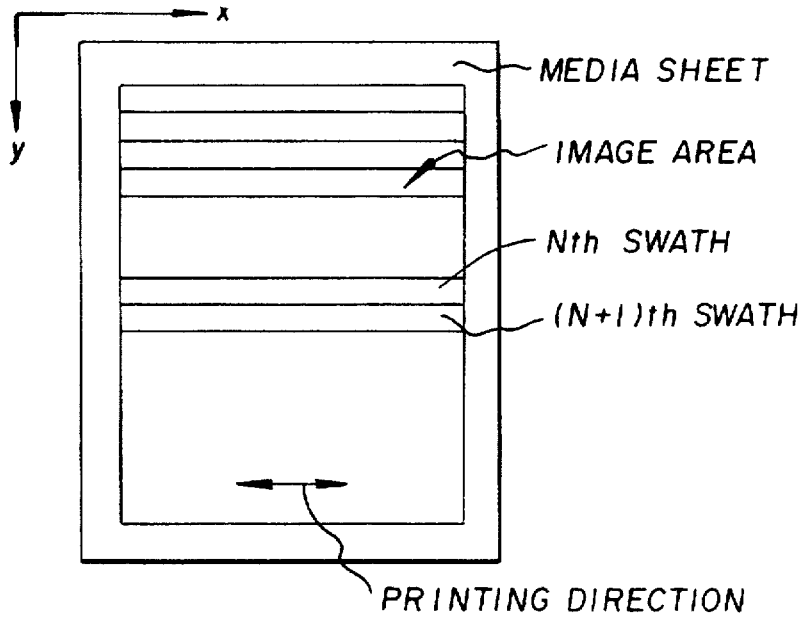
FIG. 1 ( PRIOR ART )
FIG. 1 shows print areas of adjacent passes of a printhead segment according to the prior art.
Figure 2:
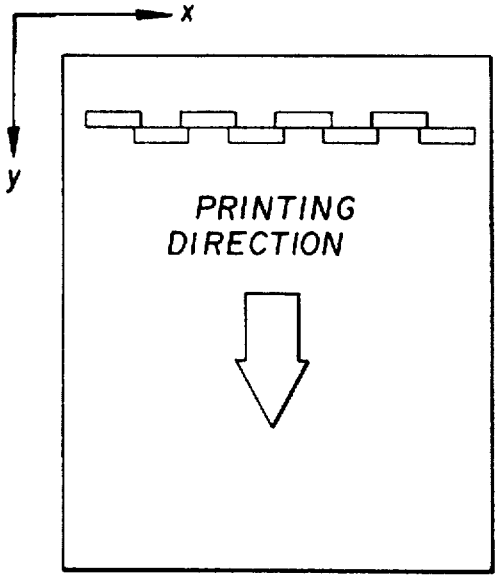
FIG. 2 illustrates the layout of an embodiment of a printhead array of segments that is consistent with this invention.
Figure 3:
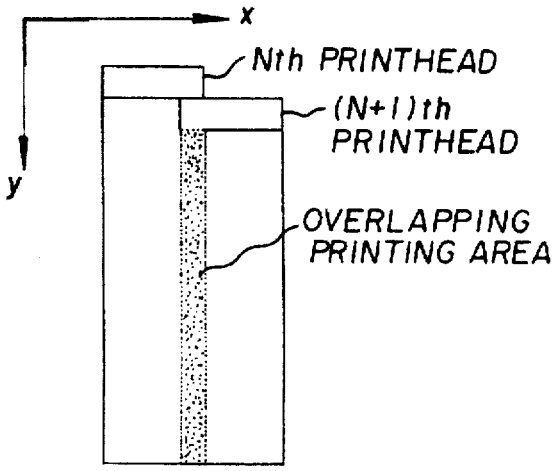
FIG. 3 shows an overlapping print area of two adjacent segments of the printhead array of FIG. 2.
Figure 4A:
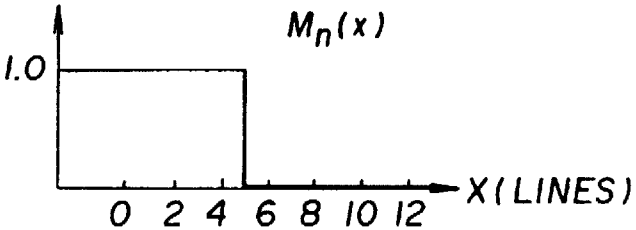
FIGS. 4(*a*) and 4(*b*) graphically represent modulation functions of two ideally spaced adjacent printhead segments according to the prior art.
Figure 4B:
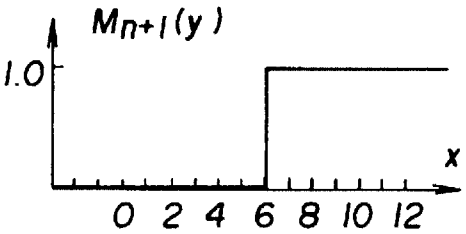
Figure 4C:
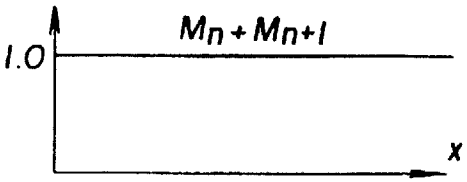
Figure 7A:
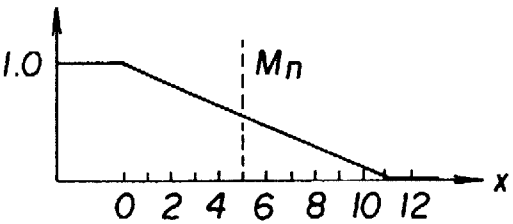
FIGS. 7(*a*) and 7(*b*) graphically represent modulation functions of two ideally spaced adjacent printhead segments according to the present invention.
Figure 7B:
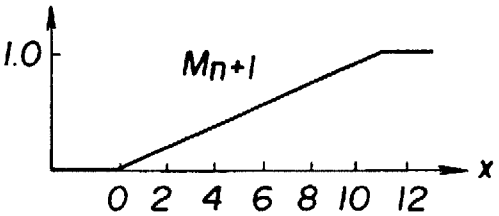
Figure 7C:
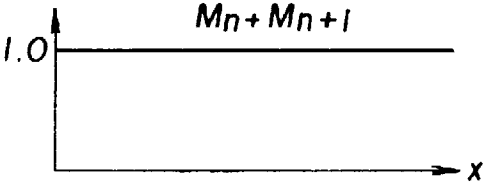

According to the present invention, the discontinuous modulation functions illustrated in FIGS. 4(*a*) and 4(*b*) are replaced by modulation functions that gradually change from ONE to ZERO over a range of pixels, as graphically illustrated in FIGS. 7(*a*) and 7(*b*) for two adjacent printhead segments. The range of pixels over which the modulation function changes extend from pixel 0 to pixel 11 of the illustration. These gradually-changing modulation functions have the following properties:

1. The sum of the $n^{th}$ and $(n+1)^{th}$ modulation function is equal to one.
2. The modulation function may monotonically vary from ZERO to ONE, or vice versa, along the x-direction in a range wider than one pixel.
3. The $n^{th}$ and $(n+1)^{th}$ modulation functions are of mirror symmetry relative to the border between printhead segments.

The total modulation function applied to the media sheet is the sum of the modulation functions of all the segments in the printhead array. FIG. 7(*c*) illustrates the ideal modulation function applied to the media sheet by the modulation functions of FIGS. 4(*a*) and 4(*b*). Under such ideal conditions, there is no advantage over the system illustrated in FIG. 4(*c*).

Figure 5A:
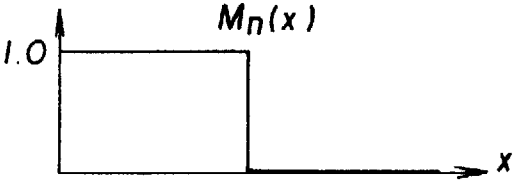
FIGS. 5(*a*) and 5(*b*) graphically represent modulation functions of two overlapping adjacent printhead segments according to the prior art.
Figure 5B:
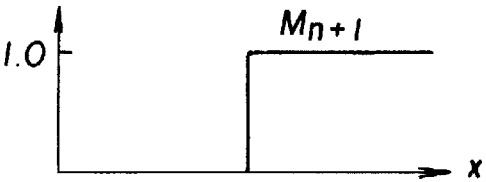
Figure 5C:
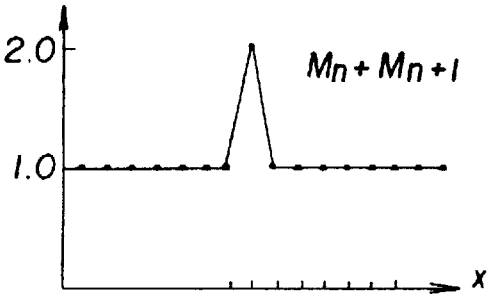
Figure 8A:
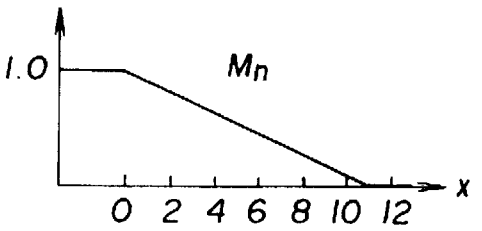
FIGS. 8(*a*) and 8(*b*) graphically represent modulation functions of two overlapping adjacent printhead segments according to the present invention.
Figure 8B:
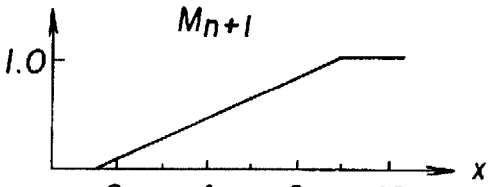
Figure 8C:
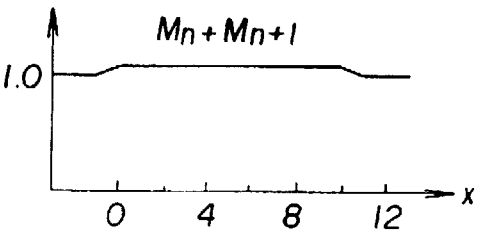

In contrast, the printing by two adjacent printhead segments that have a single-pixel overlap is graphically represented by modulation functions of FIGS. 8(*a*) and 8(*b*), respectively. Again, the total modulation function applied to the media sheet is the sum of the modulation functions of all the segments in the printhead array. FIG. 8(*c*) illustrates the modulation function applied to the media sheet by the modulation functions of FIGS. 8(*a*) and 8(*b*). Note that when the two modulation functions overlap by one pixel, the resulting total modulation function is only 1/11 higher than one, and the error is spread across a range of eleven pixels. This creates a lighter and wider "band" that is much less visible than the dark band that would result from the modulation function shown in FIG. 5(*c*), wherein a dark band would result at the overlap, as indicated by the positive spike in the modulation function of FIG. 5(*c*).

Figure 6A:
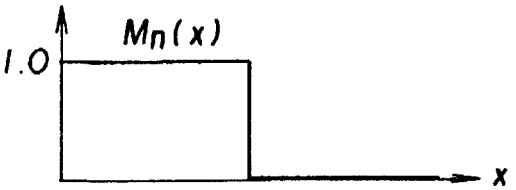
FIGS. 6(*a*) and 6(*b*) graphically represent modulation functions of two gapped adjacent printhead segments according to the prior art.
Figure 6B:
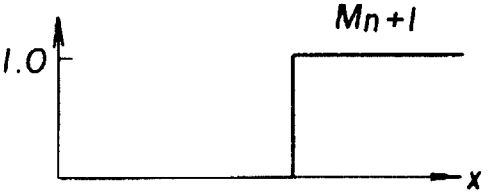
Figure 6C:
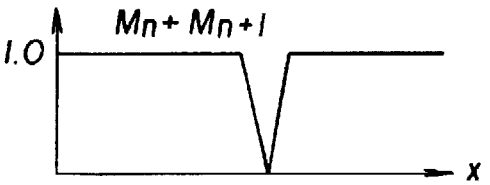
Figure 9A:
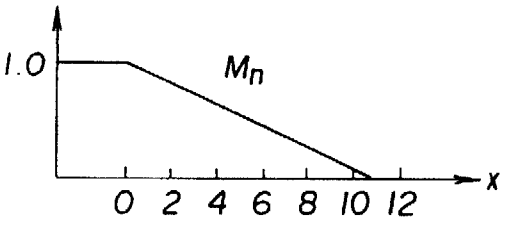
FIGS. 9(*a*) and 9(*b*) graphically represent modulation functions of two gapped adjacent printhead segments according to the present invention.
Figure 9B:
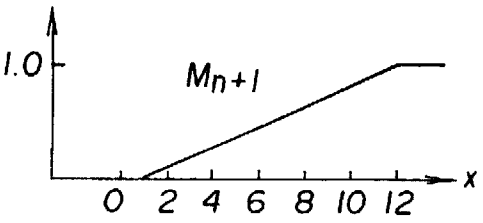
Figure 9C:
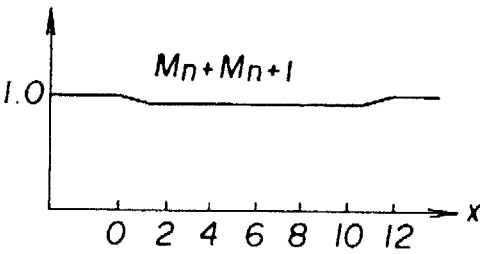

Printing according to the present invention by two adjacent printhead segments that have a single-pixel gap is graphically represented by modulation functions of FIGS. 9(*a*) and 9(*b*), respectively. Once again, the total modulation function applied to the media sheet is the sum of the modulation functions of all the segments in the printhead array. FIG. 9(*c*) illustrates the modulation function applied to the media sheet by the modulation functions of FIGS. 9(*a*) and 9(*b*). When a gap of one pixel is left between the two swaths, an eleven-pixel wide light band is resulted on the total modulation function. The resulting total modulation function is only 1/11 lower than one, and the error is spread across a range of eleven pixels. This creates a darker and wider "band" that is much less visible than the light band that would result from the modulation function shown in FIG. 6(*c*), wherein a light band would result at the gap, as indicated by the negative spike in the modulation function of FIG. 6(*c*).

The three properties of the modulation function at a fixed y position and near the border of print areas of the nth and (n+1)th printheads follows:

$$m_n(x)+m_{n+1}(x)=1 \quad (1)$$

$$\partial m_n(x)/\partial x \leqq 0 \text{ and } \partial m_{n+1}(x)/\partial x \geqq 0 \quad (2)$$

$$m_n(x)=m_{n+1}(w-x) \quad (3)$$

where (0,w) is the variation range of the modulation functions. In FIGS. 7–9, w equals 11.

Assuming f(x) is the intended actuation function for the number of heating pulses to be printed along the y direction at the x position, the ideal performance of the printhead array is as follows:

$$f(x)=f(x)\sum_n m_n(x). \quad (4)$$

Near the border of the printing areas of the $n^{th}$ and $(n+1)^{th}$ printheads:

$$f(x)=f(x)\,[m_n(x)+m_{n+1}(x)]. \quad (5)$$

For the conventional printers, the modulation function is a step function at the borders:

$$m_n(x)=1-e(x-b-1) \quad (6)$$

and $$m_{n+1}(x)=e(x-b-1) \quad (7)$$

where the border is between the b and b+1 pixels. $e(x)=1$ for $x\geqq 0$, and $e(x)=0$ for $x<0$. The dark banding is produced by the overlapping of the two areas. For example, if the border of the $(n+1)^{th}$ printhead starts at the $b^{th}$ pixel rather than $(b+1)^{th}$ pixel, $$m_{n+1}(x)=e(x-b) \quad (8)$$

and $$m_n(x)+m_{n+1}(x)=1+e(x-b)-e(x-b-1)=1+d(x-b-1) \quad (9)$$

where $d(x-b-1)=1$ if $x=b+1$ and $d(x-b-1)=0$ elsewhere.

Similarly, a light band is produced if the $(n+1)^{th}$ printhead starts at the $(b+2)^{th}$ pixel rather than the (b+1)th pixel:

$$m_{n+1}(x)=e(x-b-2) \quad (10)$$

and $$m_n(x)+m_{n+1}(x)=1+e(x-b-2)-e(x-b-1)=1-d(x-b-1) \quad (11)$$

The example for the new modulation functions used in FIGS. 7–9 is:

$$\begin{aligned} m_{n+1}(x) &= 0\ x<0 \\ &= x/w \text{ in } (0, w) \\ &= 1\ x \geqq w \end{aligned} \quad (12)$$

It is easy to prove that for a "dark band":

$$\begin{aligned} m_n(x)+m_{n+1}(x) &= 1+1/w \text{ in } (0, w-1) \\ &= 1 \text{ elsewhere.} \end{aligned} \quad (13)$$

So the effects of banding can minimized by increasing w so that it is invisible to human eyes. For a "light band":

$$\begin{aligned} m_n(x)+m_{n+1}(x) &= 1-1/w \text{ in } (1, w) \\ &= 1 \text{ elsewhere} \end{aligned} \quad (14)$$

According to the illustrated embodiment of the present invention, the multi-segment printhead is of page width. With a page-wide printhead, the printer can produce one image plane on the media sheet in a single pass. But the large printhead is difficult to fabricate and costly, even with the image improvements of the present invention. For multi-segment printheads narrower than the page width, multiple parallel swaths are printed for printing each image plane. The swaths can be along either the longer or the shorter dimension of the media sheet. The width of the swaths is determined by the width of the printhead. The printing can be bi-directional or uni-directional.

Advantages:

The present invention enables low-cost and high printing-speed applications. The design idea is generally applicable to digital printers such as those using resistive thermal, ink jet, laser, and silver halide technologies; whether continuous tone or halftone. The invention is applicable to both color and black and white printers. The degree of suppression of the banding effects can be optimized by adjusting the width of the variation of the modulation function so that the banding effect is invisible to the eye.

The invention has been described in detail with particular reference to preferred embodiments thereof, but it will be understood that variations and modifications can be effected within the spirit and scope of the invention.

What is claimed is:

1. A recording method for a printer having a printhead formed of an array of narrow segments that are distributed across the printhead so that there is a boundary between adjacent segments, said method comprising the steps of:

applying a two-dimensional modulation function to each of the segments to produce bands of pixels on a recording medium, said modulation function defining segment actuation as a function of position of each segment relative to the recording medium, said modulation function gradually decreasing from ONE to ZERO toward the boundary between each of said segments and the adjacent segment; and creating relative movement between the printhead and the recording medium while applying image-wise drive signals to the printhead.

2. A recording method as set forth in claim 1 wherein the modulation functions applied to adjacent segments are of mirror symmetry.

3. A recording method as set forth in claim 1 wherein each modulation function decreases from ONE to ZERO over a range of more than one pixel.

4. A recording method as set forth in claim 3 wherein each modulation function decreases from ONE to ZERO over a range of about twelve pixels.

5. A recording method as set forth in claim 1 wherein the printhead is as wide as a full print line across the media.

6. A recording method as set forth in claim 1 wherein the segments are staggered across the printhead.

7. A recording method for a printer having a printhead formed of an array of narrow segments that are distributed across the printhead so that there is a boundary between adjacent segments, said method comprising the steps of:

applying a first two-dimensional modulation function to one of the segments to produce a first band of pixels on a recording medium, said first modulation function defining segment actuation as a function of position of each segment relative to the recording medium, said first modulation function gradually decreasing from ONE to ZERO toward the boundary between said one segment and the adjacent segment; and applying a second two-dimensional modulation function to the adjacent segment to produce a second band of pixels on the recording medium adjacent the end of the first band, said second modulation function defining segment actuation as a function of position of each segment relative to the recording medium, said second modulation function gradually decreasing from ONE to ZERO toward the boundary such that a total modulation function applied to the recording medium is a sum of the modulation functions of the first and second bands.

8. A recording method as set forth in claim 7 wherein the first and second modulation functions are of mirror symmetry.

9. A recording method as set forth in claim 7 wherein each modulation function decreases from ONE to ZERO over a range of more than one pixel.

10. A recording method as set forth in claim 9 wherein each modulation function decreases from ONE to ZERO over a range of about twelve pixels.

11. A recording method as set forth in claim 7 wherein the printhead is as wide as a full print line across the media.

12. A recording method as set forth in claim 7 wherein the segments are staggered across the printhead.

13. A printer having a printhead formed of an array of narrow segments that are distributed across the printhead so that there is a boundary between adjacent segments, said printer comprising:

means for applying a two-dimensional modulation function to each of the segments to produce bands of pixels on a recording medium, said modulation function defining segment actuation as a function of position of each segment relative to the recording medium, said modulation function gradually decreasing from ONE to ZERO toward the boundary between each of said segments and the adjacent segment; and means for creating relative movement between the printhead and the recording medium while applying imagewise drive signals to the printhead.

14. A printer as set forth in claim 13 wherein the printhead is as wide as a full print line across the media.

15. A printer as set forth in claim 13 wherein the segments are staggered across the printhead.

16. A printer having a printhead formed of an array of narrow segments that are distributed across the printhead so that there is a boundary between adjacent segments, said printer comprising:

means for applying a first two-dimensional modulation function to one of the segments to produce a first band of pixels on a recording medium, said first modulation function defining segment actuation as a function of position of each segment relative to the recording medium, said first modulation function gradually decreasing from ONE to ZERO toward the boundary between said one segment and the adjacent segment; and means for applying a second two-dimensional modulation function to the adjacent segment to produce a second band of pixels on the recording medium adjacent the end of the first band, said second modulation function defining segment actuation as a function of position of each segment relative to the recording medium, said second modulation function gradually decreasing from ONE to ZERO toward the boundary such that a total modulation function applied to the recording medium is a sum of the modulation functions of the first and second bands.

17. A printer as set forth in claim 16 wherein the printhead is as wide as a full print line across the media.

18. A printer as set forth in claim 16 wherein the segments are staggered across the printhead.

* * * * *